US006701823B2

(12) United States Patent
Weber et al.

(10) Patent No.: US 6,701,823 B2
(45) Date of Patent: Mar. 9, 2004

(54) METHOD AND DEVICE FOR CONTROLLING A LIFT CYLINDER, ESPECIALLY OF WORKING MACHINES

(75) Inventors: Jürgen Weber, Dresden (DE); Volker Bösebech, Kamen (DE)

(73) Assignee: O&K Orenstein & Koppel Aktiengesellschaft, Dortmund (DE)

( * ) Notice: Subject to any disclaimer, the term of this patent is extended or adjusted under 35 U.S.C. 154(b) by 20 days.

(21) Appl. No.: 10/182,688

(22) PCT Filed: Feb. 2, 2001

(86) PCT No.: PCT/EP01/01121

§ 371 (c)(1),
(2), (4) Date: Jul. 30, 2002

(87) PCT Pub. No.: WO01/57405

PCT Pub. Date: Aug. 9, 2001

(65) Prior Publication Data

US 2003/0000373 A1 Jan. 2, 2003

(30) Foreign Application Priority Data

Feb. 4, 2000 (DE) ..... 100 04 905

(51) Int. Cl.[7] ..... F15B 13/02; F15B 11/024
(52) U.S. Cl. ..... 91/436; 91/466
(58) Field of Search ..... 60/486; 91/436, 91/462, 463, 466

(56) References Cited

U.S. PATENT DOCUMENTS 4,434,708 A 3/1984 Bowden ..... 91/436
5,022,434 A * 6/1991 Tsukimoto ..... 91/436
5,062,349 A 11/1991 Khan ..... 91/436
5,791,226 A * 8/1998 Chung et al. ..... 91/436
6,164,327 A * 12/2000 Yoshida ..... 91/436
6,581,639 B2 * 6/2003 Fiala et al. ..... 91/436

FOREIGN PATENT DOCUMENTS

| | | |
|---|---|---|
| DE | 1406784 | 4/1969 |
| EP | 0262098 | 3/1988 |
| EP | 0629781 | 12/1994 |
| WO | 9836175 | 8/1998 |

* cited by examiner

*Primary Examiner*—Thomas E. Lazo
(74) *Attorney, Agent, or Firm*—Collard & Roe, P.C.

(57) ABSTRACT

By means of a method and a device for controlling a lift cylinder (2) of working machines, wherein the hydraulic oil from the pressure cylinder space (12) is forced via a control element (3) into the suction cylinder space (11) during lowering by an external force, it is possible in particular to achieve automatic changeover between normal operation and an operating condition in which an additional force in vertical direction can be exerted.

Figure 1A:
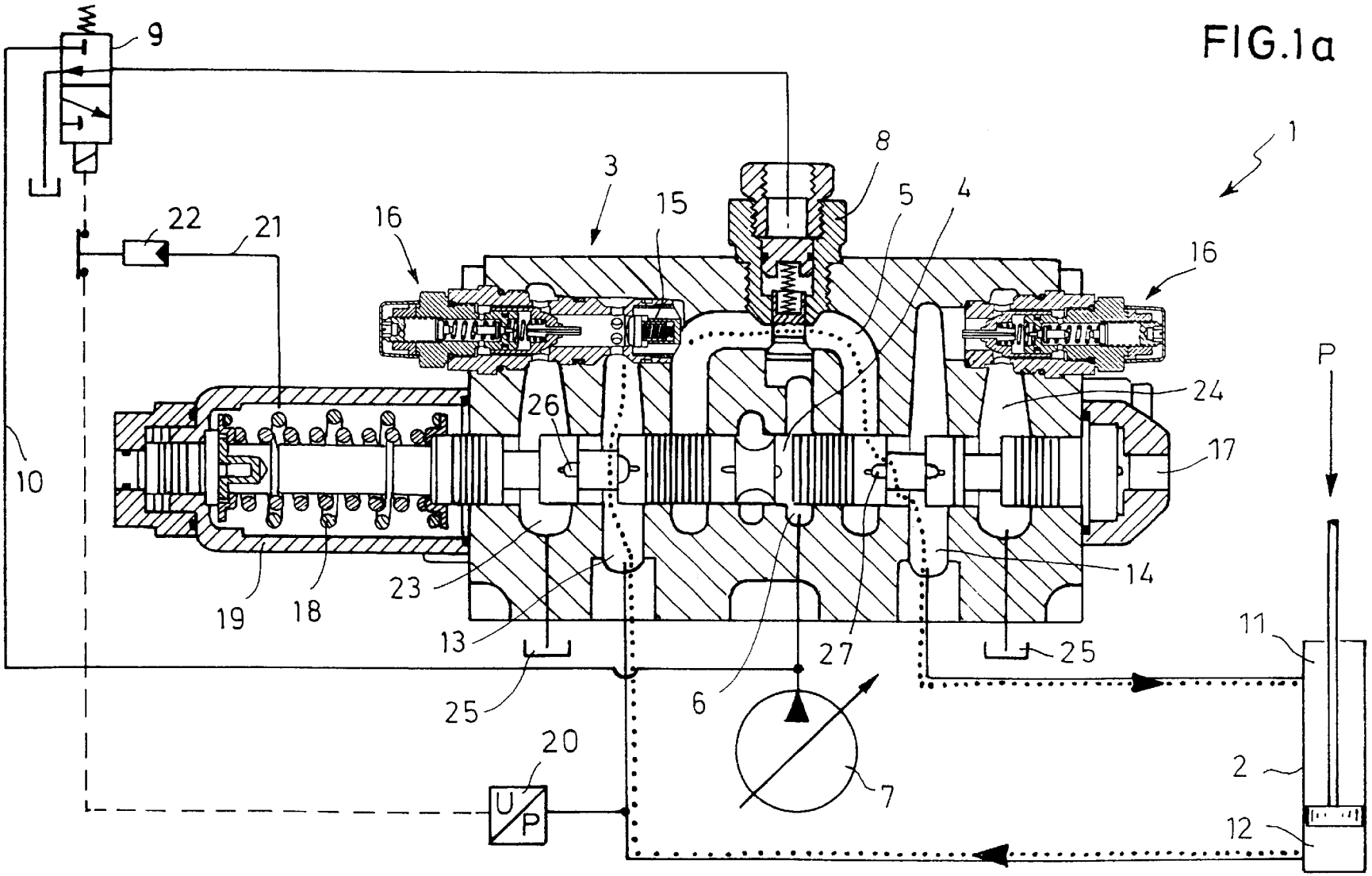

This is achieved in particular by the fact that, at a first predetermined force, the hydraulic oil arriving from the pressure space (12) is forced via a check valve (15) in control element (3) through the distribution channel (5) pressurized by the hydraulic pump (7) and from this into the suction cylinder space (11), the feed flow of the hydraulic pump (7) being shut off by a pressure-controlled stop valve (8), this stop valve (8) opening and the check valve (15) closing in response to a pressure drop, so that, by means of the pump (7), an additional force can be exerted on the suction cylinder space (11).

7 Claims, 5 Drawing Sheets

METHOD AND DEVICE FOR CONTROLLING A LIFT CYLINDER, ESPECIALLY OF WORKING MACHINES

CROSS REFERENCE TO RELATED APPLICATIONS

Applicants claim priority under 35 U.S.C. §119 of GERMAN Application No. 100 04 905.2 filed on Feb. 4, 2000. Applicants also claim priority under 35 U.S.C. §365 of PCT/EP01/01121 filed on Feb. 2, 2001. The international application under PCT article 21(2) was not published in English.

The invention relates to a method and to a device for controlling a lift cylinder of the class specified in claim 1 or 2.

Hydraulic lift cylinders of working machines can be lowered without additional energy input when they are under load, in which case it is standard practice to ensure oil filling both on the piston side, or in other words in the pressure cylinder space, and on the rod side, or in other words in the suction cylinder space.

It is known that lift cylinders of working machines can be lowered by directing the pressurized oil forced out by the load to a tank by means of a control unit or by natural flow, while the hydraulic pump delivers hydraulic oil to the suction side of the cylinder in order to prevent cavitation. This procedure suffers from the disadvantage that additional energy must be expended for filling the suction side.

In another solution, the suction side of the cylinder is connected to the tank, so that the oil is sucked out of the tank by the suction side, thus causing the disadvantage that line resistances between the cylinder and tank must be overcome, possibly leading to incomplete filling of the cylinder. This is countered by flow restrictors in the tank return line, but then heat is generated and must be removed by cooling.

For reasons of energy economy, the challenge comprises being able to lower the cylinder in controlled manner without input of energy, or in other words to use the energy of the hydraulic oil flowing out of the lift side for filling the suction side without the need for flow restrictors. For this purpose it is known that the pressurized outflowing hydraulic oil can be directed by a control element to the suction side of the cylinder, in which case a separate lowering valve, for example, is provided between cylinder and main control valve and, during the lowering process, is actuated instead of the main slide valve, in order to direct the necessary partial quantity to the suction side of the cylinder, while the remaining quantity can bypass the main slide valve and flow off into the tank.

There is also known a further solution in which the main control slide valve for the lift cylinder can be designed as a hollow piston, which in lowering position establishes a transfer line between the pressure side and the suction side of the cylinder, in which case a check valve is disposed in the hollow piston to disconnect the connection during normal operation. The production of such a hollow piston as a control piston in the main control slide valve is expensive, and the corresponding circuit for lowering under gravity has the disadvantage that the lift cylinder cannot apply any additional force in lowering direction. In order to achieve an effect in lowering direction also, the circuit for lowering under gravity must be disconnected.

Compared with the known solutions described in the foregoing, the object of the invention is to provide a procedure and a device with which, by adjustment of the control slide valve, the suction space of the cylinder is adequately filled under all pressure conditions during the lowering process, a changeover to normal operation of the cylinder taking place as soon as an additional cylinder force in lowering direction is needed.

According to the invention, this object is achieved with a method of the type cited in the introduction by the fact that

- a distribution channel in the control element is pressurized by the hydraulic pump, whereupon the pressure cylinder space or the suction cylinder space is connected via a control piston,
- at a first predetermined pressure produced in the cylinder space by the external force/load (P), the cylinder space is connected via a check valve to this distribution channel and the feed flow from the pump to the distribution channel is stopped by a stop valve that can be influenced by a pressure sensor, whereupon the suction cylinder space is connected to the channel, and
- when a second predetermined pressure is reached, the check valve closes and the stop valve is opened, thus allowing feed flow from the hydraulic pump to the distribution channel for application of an additional force in the suction cylinder space.

From the viewpoint of device design, the object cited in the foregoing is achieved by the fact that there is provided, in the control element, a distribution channel that can be pressurized by the hydraulic pump, the distribution channel having two outlet channels that can be connected and disconnected via a control piston, the outlet channels having connecting lines to the pressure cylinder space and suction cylinder space respectively of the lift cylinder, a check valve being provided between the channel and the distribution channel, a stop valve that influences the pump feed flow being provided in the distribution channel, a pressure sensor being provided between channel and pressure cylinder space and a switch that can be activated thereby being provided for actuation of a hydraulic valve for actuation of the stop valve.

By means of the inventive procedure it is evidently possible, via the control element, to direct the oil arriving from the pressure space of the cylinder to the suction side, in which case pressure monitoring in the pressure space as well as appropriate adjustment of the check valve and switching of the position of the control valve ensures lowering without application of an external force.

In this connection it is particularly expedient that, in the case of complete lowering of the working machine by the hydraulic cylinder, for example, the pressure in the pressure space of the cylinder can be reduced or completely adapted to the system pressure, by the fact that the check valve closes and the stop valve can be opened if necessary. This is also possible without problems for the case of lowering under pressure, in which case, via the stop valve, pressurization that can act in lowering direction is made possible by the pump. If the control piston in the control element is switched, the pump can then act in lifting direction by pressurizing the pressure space.

If, for example, a pressure of greater than 20 bar due to the external force is signaled to the pressure switch, the control valve is switched to such a position that the hydraulic fluid closes the stop valve in the pump distribution channel and thus stops the feed flow of hydraulic oil from the pump, so that the hydraulic oil flows out of the pressure cylinder space of the cylinder via the check valve into the suction cylinder space, while excess oil can be directed back into the tank if necessary.

If, for example, the pressure drops in response to a decrease of external load in the pressure cylinder space, the check valve closes. A control signal is automatically transmitted via the pressure sensor to the relay valve, whose position is switched, thus depressurizing the stop valve, so that this automatically opens and allows feed flow of hydraulic oil via the pump to the suction side of the cylinder, thus permitting pressure to be exerted on the cylinder in lowering direction.

If lifting is required, the control side of the piston is depressurized, so that this spring-loaded piston extends, thus opening feed flow of hydraulic oil to the pressure side of the piston.

Further embodiments of the invention are specified in the dependent claims.

In a particularly advantageous embodiment, for example, control grooves that enable flow to and from both the lift and suction sides of the cylinder are provided at the control edges of the control piston, the grooves on the lift and suction sides corresponding to the ratio of areas of the lift and suction sides of the cylinder.

An expedient and compact construction is also achieved by forming the check valve as an integral unit with a secondary pressure limiting valve.

The invention also makes it possible to use two pumps, in which case it is expedient to provide at least one controlled stcp valve and one controlled check valve in the system.

Figure 1B:
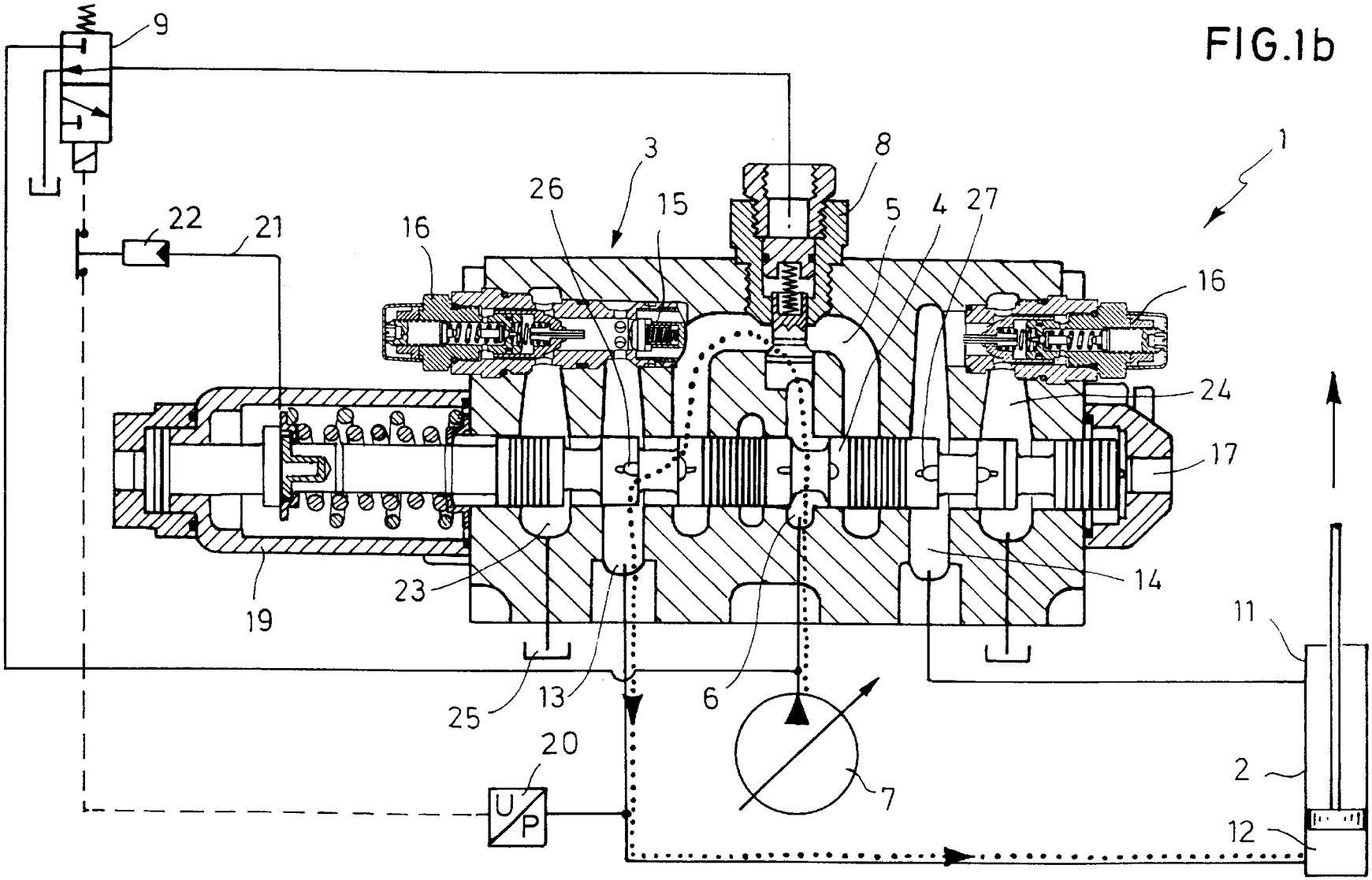

Further details, features and advantages of the invention will become apparent from the description given hereinafter and from the drawing, wherein FIGS. 1*a* and 1*b* show a first practical example of the invention with the "Lower" position of some device elements in FIG. 1*a* and the "Lift" position of some device elements in FIG. 1*b,*

Figure 2:
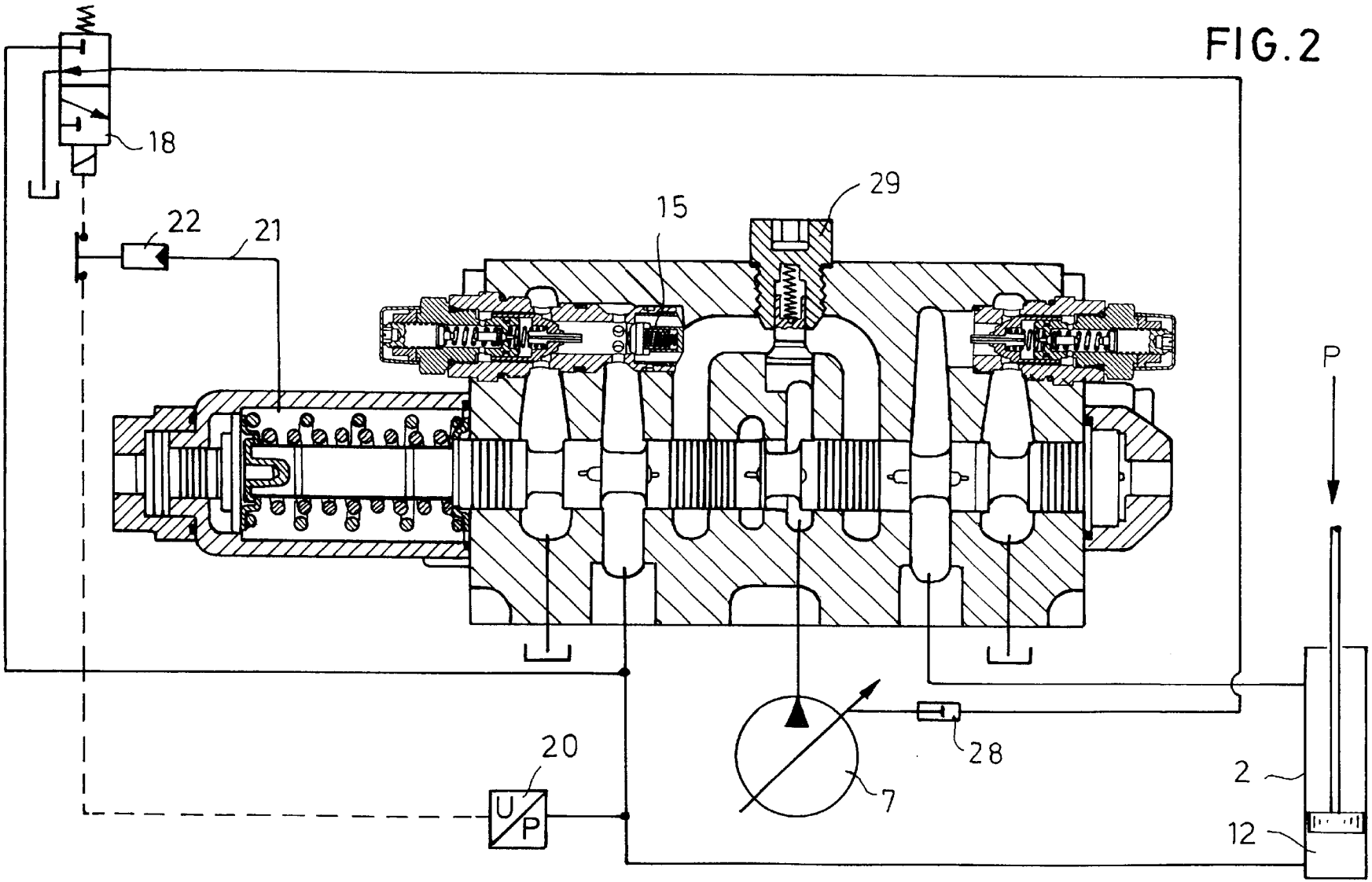
Figure 3:
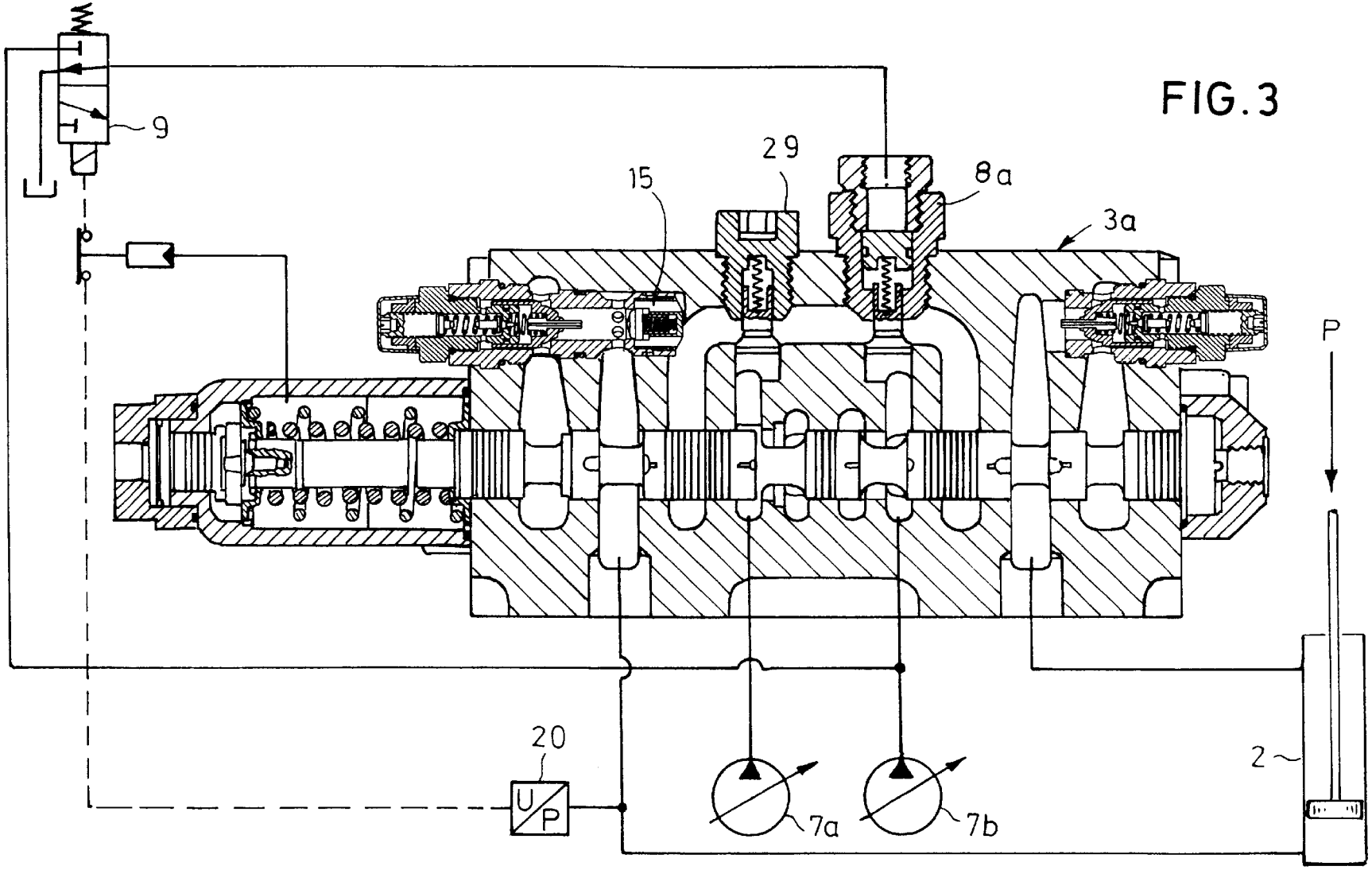
Figure 4:
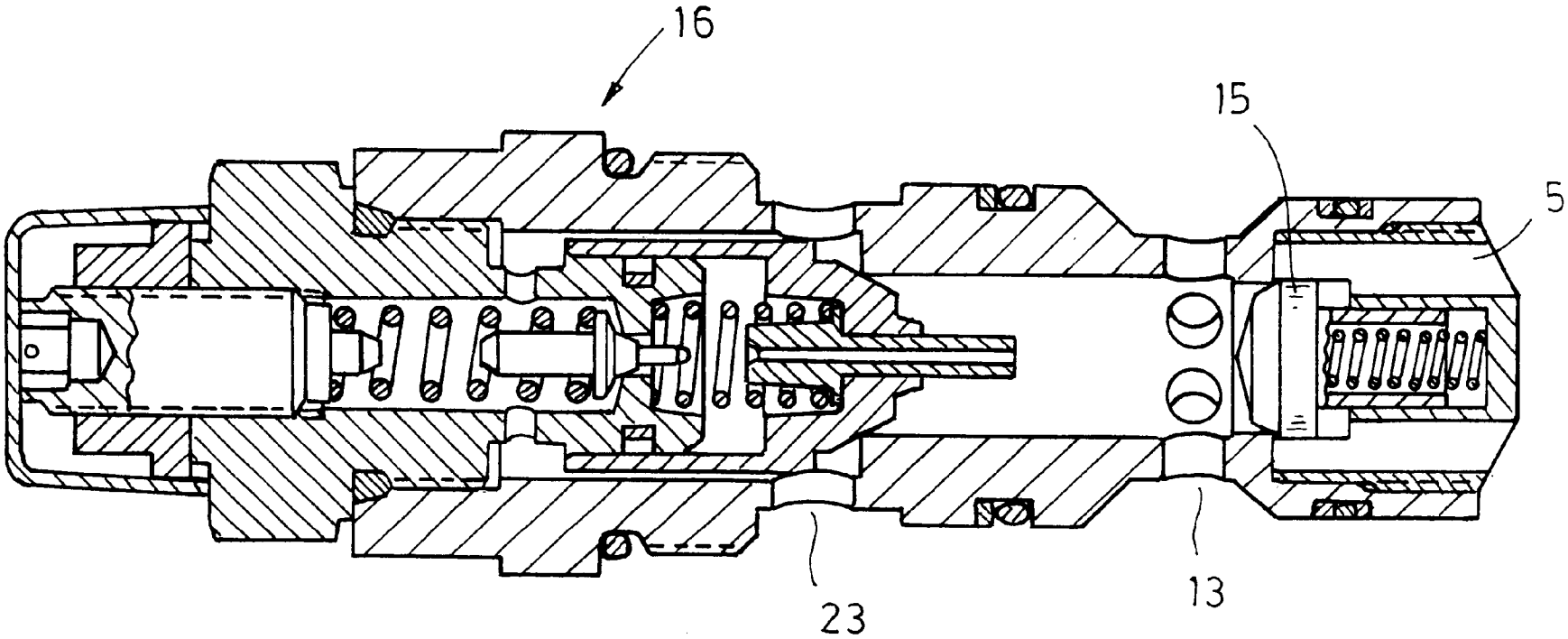

FIG. 2 shows a modified practical example of the device according to FIG. 1, FIG. 3 shows an example with two pumps, and FIG. 4 shows an enlarged diagram of an installed secondary safety device with integrated check valve.

The device, denoted in general by 1 in the figures, for control of the movement of a lift cylinder denoted by 2 is shown partly symbolically and otherwise in section in the figures, and it comprises substantially a control element 3 with a control piston 4 which is displaceable therein and by means of which different channels, to be described in more detail hereinafter, can be opened, closed or connected to one another.

In the example of FIG. 1 there is provided in control element 3 a distribution channel 5 of approximately U-shaped appearance in cross section, pressurized approximately symmetrically by a pump channel 6, to which a hydraulic-oil pump 7 is connected. To shut off the feed flow via pump channel 6 to distribution channel 5 there is provided at approximately the center a stop valve 8 which, via a relay valve, can be connected by means of a pump feed-flow line 10 to pump 7.

Cylinder 2 is provided with a suction space 11 and a pressure space 12, which is defined by an externally applied load (arrow P), which are connected via lines to a pressure channel 13 and a suction channel 14 in control element 3, defined in the same way according to the aforesaid pressure definition, pressure channel 13 and suction channel 14 being disposed parallel to the two partial arms of pump distribution channel 5 and all of these channels being compressed or extended via control piston 4.

At sufficiently high pressure in channel 13, hydraulic fluid can flow, as described in more detail hereinafter, from there into distribution channel 5 via a check valve 15 disposed in a secondary safety device 16 and shown on larger scale in FIG. 4.

Besides the described elements, or in other words control element 3, device 1 is provided in the axis of control piston 4, at one end, with a control port 17, via which, during application of pressure, control piston 4 can be pushed in opposition to a spring 18 installed inside a spring cap 19.

The pressure in pressure cylinder space 12 and in the line leading therefrom to pressure channel 13 can be measured by pressure sensor 20. Via a line 21 from spring cap 19 there can be activated a switch 22, which in turn switches valve 9 into connection with pressure sensor 20. Besides the double-acting distribution channel 5 and pressure channel 13 as well as suction channel 14, there are provided in control element 3 two further parallel tank channels 23 and 24, which on the one hand are each pressurized by a secondary safety device 16 and on the other hand form the delivery lines to tank 25, in order to take care of any overflow after each switching process.

In order to permit a corresponding through flow, control piston 4 is provided at the appropriate places with control grooves 26 and 27.

The functional principle of device 1 will be explained in more detail hereinafter on the basis of the examples of FIGS. 1*a* and 1*b:*

If the piston of the control slide valve is switched to "Lower" (FIG. 1) via control port 17, piston 4 is moved toward spring cap 19. External load P generates a pressure in cylinder space 12 of cylinder 2, and the pressurized fluid of cylinder space 12 flows into distribution channel 5 via channel 13 and check valve 15, which in this example is installed in the cartridge of secondary safety device 16 (FIG. 4). Via control grooves 27 the pressurized fluid passes into channel 14, which leads to suction space 11 of cylinder 2. The pressure in cylinder space 12 also trips pressure sensor 20, which actuates valve 9 and thus relays the pressure of pump 7 to stop valve 8, which therefore closes.

At the same time, a connection to tank channel 23 is established via control groove 26 due to the displacement of control slide-valve piston 4. Since the pressures in channels 5 and 13 and thus also at control grooves 26 and 27 are equal when check valve 15 is open, the form of control grooves 26 and 27 can be configured such that the necessary quantity of hydraulic oil is made available to suction space 11 of cylinder 2 under all control-piston positions and pressure conditions, while the remaining quantity is delivered to tank 25. The quantity ratio of the hydraulic oil flowing off to tank 25 and to suction space 11 of cylinder 2 then remains constant. The flow of hydraulic oil from cylinder space 12 to cylinder space 11 is indicated by dotted lines.

Simultaneously with activation of the lowering process, the delivery flow of pump 7 can be driven to zero or directed to other load points by suitable switching means. Thereby distribution channel 5 is depressurized and stop valve 8 closes automatically in this case as well.

If load P is being lowered to the ground, the pressure in cylinder space 12 will be in the region of zero. Pressure sensor 20 identifies this condition, removes the pump pressure from stop valve 8 and thus establishes normal operation for the lowering process. In order to hold stop valve 8 open for the lifting process, switch 22 interrupts the signal from pressure sensor 20 to valve 9, whereupon stop valve 8 is depressurized and can open.

Switch 22 is switched to "Lift" position (FIG. 1*b*) by the control signal, which in this example is derived from spring cap 19 via line 21. In FIG. 1*b* also, the flow of hydraulic oil during lifting is indicated by dotted lines. By means of this inventive arrangement, regenerative switching during lowering under load is achieved, while the "Lower" and "Lift"

functions with the pump are automatically adjusted as normal operation.

As shown in FIG. 2, the pressure of cylinder space 12 in a second embodiment of the invention is relayed via valve 9 through a line to a pump regulator 28, and so the delivery flow of pump 7 is set to zero. In this embodiment, a check valve 29 can be provided instead of a controlled stop valve. This embodiment with check valve 29 can be used in all systems in which the pump feed flow to channel 5 is interrupted when the lowering process for cylinder 2 is activated.

A third embodiment of the invention is illustrated in FIG. 3. In this case two pumps 7*a* and 7*b* are directed into the control slide valve, exclusively pump 7*a* being provided for lowering while the regenerative circuit is disconnected and pumps 7*a* and 7*b* being provided for lifting. In this case the pump pressure of pump 7*a* is relayed via valve 9 to valve 8*a*. In this example, pump 7*a* is disconnected by other load points or depressurized during lowering, and so the check valve is provided for this circuit.

An advantageous arrangement of check valve 15 is illustrated in FIG. 4. Valve blocks for working machines are provided with secondary safety devices 16. An advantageous and economically more favorable embodiment is achieved when check valve 15 is disposed in the housing of secondary safety devices 16 in such a way that check valve 15 connects channel 13 to distribution channel 5.

What is claimed is:

1. A method for controlling a lift cylinder (2) of working machines such as excavators, wheeled loaders or the like, wherein the lift cylinder (2) can be pressurized in vertical direction by an external force (external load P), wherein the pressure cylinder space (12) and the suction cylinder space (11) of the lift cylinder (2) are pressurized with pressurized fluid via a line connecting these two spaces (11, 12) to one another and containing a control element (3), wherein the control element (3) controls the flows to and from the cylinder spaces (12, 11) and the overflow into a tank (25) for the working medium via a hydraulic pump (7), characterized in that a distribution channel (5) in the control element (3) is pressurized by the hydraulic pump (7), whereupon the pressure cylinder space (12) or the suction cylinder space (11) is connected via a control piston (4), in that, at a predetermined pressure produced in the cylinder space (12) by the external force/load (P), the cylinder space is connected via a check valve (15) to this distribution channel (5) and the feed flow from the pump (7) to the distribution channel (5) is stopped by a stop valve (8) that can be influenced by a pressure sensor (20), whereupon the suction cylinder space (11) is connected to the channel (5), and in that, when another predetermined pressure is reached, the check valve (15) closes and the stop valve (8) is opened, thus allowing feed flow from the hydraulic pump (7) to the distribution channel (5) for application of an additional force in the suction cylinder space (11).

2. A device (1) for controlling a lift cylinder (2) of working machines such as excavators, wheeled loaders or the like, wherein the lift cylinder (2) can be pressurized in vertical direction by an external force (external load P), wherein the pressure cylinder space (12) and the suction cylinder space (11) of the lift cylinder (2) are pressurized with pressurized fluid via a line connecting these two spaces (11, 12) to one another and containing a control element (3), wherein the control element (3) controls the flows to and from the cylinder spaces (12, 11) and the overflow into a tank (25) for the working medium via a hydraulic pump (7), characterized in that there is provided, in the control element (3), a distribution channel (5) that can be pressurized by the hydraulic pump (7), the distribution channel having two outlet channels (13, 14) that can be connected and disconnected via a control piston (4), the outlet channels having connecting lines to the pressure cylinder space (12) and suction cylinder space (11) respectively of the lift cylinder (2), a check valve (15) being provided between the channel (13) and the distribution channel (5), a stop valve (8) that influences the pump feed flow being provided in the distribution channel (5), a pressure sensor (20) being provided between channel (13) and pressure cylinder space (12), and a switch (22) that can be activated thereby being provided for actuation of a hydraulic valve (9) for actuation of the stop valve (8).

3. A device according to claim 2, characterized in that control grooves (26, 27) that enable flow to and from both the lift and suction sides of the cylinder (2) are provided at the control edges of the control piston (4), the grooves on the lift and suction sides corresponding to the ratio of areas of the lift and suction sides of the cylinder (2).

4. A device according to claim 2, characterized in that the check valve (15) is formed as an integral unit with a secondary pressure limiting valve (16).

5. A device according to claim 2, characterized in that there are provided two pumps (7*a*, 7*b*) with a check valve (15), a further check valve (29) and a pressure-operated stop valve (8*a*) in the control element (3*a*).

6. A device according to claim 2, characterized in that there is provided a pump regulator (28) for regulation of the delivery pump (7) as a function of the pressure in the pressure space (12) of the cylinder (2).

7. A device according to claim 2 characterized in that there are provided control grooves for connection of the pressure channel (13) or of the suction channel (14) having associated tank channels (16 and 23) to the hydraulic oil overflow drain line into the hydraulic tank (25).

* * * * *